US008571429B2

(12) United States Patent
Kadota et al.

(10) Patent No.: US 8,571,429 B2
(45) Date of Patent: Oct. 29, 2013

(54) IMAGE FORMING APPARATUS WITH POSITIVELY-CHARGED SINGLE LAYER TYPE ELECTROPHOTOGRAPHIC PHOTORECEPTORS

(75) Inventors: Masaki Kadota, Osaka (JP); Shinki Miyaji, Osaka (JP); Masahito Ishino, Osaka (JP); Yoshitaka Imanaka, Osaka (JP); Hiroka Itani, Osaka (JP)

(73) Assignee: Kyocera Mita Corporation (JP)

( * ) Notice: Subject to any disclaimer, the term of this patent is extended or adjusted under 35 U.S.C. 154(b) by 335 days.

(21) Appl. No.: 13/118,814

(22) Filed: May 31, 2011

(65) Prior Publication Data

US 2011/0299866 A1 Dec. 8, 2011

(30) Foreign Application Priority Data

Jun. 4, 2010 (JP) ..... 2010-129102
Dec. 27, 2010 (JP) ..... 2010-290394

(51) Int. Cl.
*G03G 15/02* (2006.01)

(52) U.S. Cl.
USPC ..... 399/50; 399/128

(58) Field of Classification Search
USPC ..... 399/50, 66, 82, 85, 128, 298, 299, 302
See application file for complete search history.

(56) References Cited

U.S. PATENT DOCUMENTS

| | | | | |
|---|---|---|---|---|
| 5,930,556 | A | 7/1999 | Imamiya | |
| 6,553,192 | B2 * | 4/2003 | Maebashi | 399/50 |
| 2002/0045119 | A1 | 4/2002 | Azuma et al. | |

FOREIGN PATENT DOCUMENTS

| | | |
|---|---|---|
| JP | 5-303259 | 11/1993 |
| JP | 9-218590 | 8/1997 |
| JP | 2002-72511 | 3/2002 |
| JP | 2002-132013 | 5/2002 |
| JP | 2007-232856 | 9/2007 |
| JP | 2007-271731 | 10/2007 |

* cited by examiner

*Primary Examiner* — William J Royer
(74) *Attorney, Agent, or Firm* — Gerald E. Hespos; Michael J. Porco; Matthew T. Hespos

(57) ABSTRACT

An image forming apparatus has first and second image carriers that are configured by positively-charged single layer type electrophotographic photoreceptors, and a controller that controls an operation for charging or destaticizing circumferential surfaces of these image carriers. The controller switches between a first mode for causing the first and second image carriers to perform image formation while rotating these image carriers, and a second mode for causing only the first image carrier to perform image formation while rotating the first and second image carriers. In the second mode, the second image carrier is applied with a charging bias and subjected to a destaticizing operation without undergoing a developing operation. The first image carrier is applied with the charging bias and subjected to the developing operation and the destaticizing operation.

4 Claims, 5 Drawing Sheets

IMAGE FORMING APPARATUS WITH POSITIVELY-CHARGED SINGLE LAYER TYPE ELECTROPHOTOGRAPHIC PHOTORECEPTORS

BACKGROUND OF THE INVENTION

1. Field of the Invention

The present invention relates to an image forming apparatus that has first and second image carriers configured by positively-charged single layer type electrophotographic photoreceptors.

2. Description of the Related Art

An electrophotographic image forming apparatus, such as a copy machine, a printer, a fax machine, or a complex machine with the functions of the abovementioned devices, has, for example, a photosensitive drum functioning as an image carrier, a charging device for uniformly charging a circumferential surface of the photosensitive drum, an exposure device for forming an electrostatic latent image based on image data onto the photosensitive drum, a developing device for developing the electrostatic latent image on the photosensitive drum into a toner image, and a transfer device for transferring the toner image on the photosensitive drum to a recording medium, such as a sheet of paper, via an intermediate transfer belt and the like.

Examples of the charging device of such an image forming apparatus include a contact charging type charging device and a non-contact charging type charging device. The contact charging type charging device is known to be capable of preventing generation of ozone, unlike the non-contact charging type charging device.

Some contact charging type charging devices have charging rollers. Some conventional devices have charging rollers of electrophotographic apparatuses that use two-component toners, the charging rollers each having a shaft body, a base rubber layer formed on an outer circumference of the shaft body, and a surface layer that is formed on an outer circumference of the base rubber layer directly or with a layer interposed therebetween. In such charging rollers, the base rubber layer is made of a base rubber layer forming material that consists mainly of a rubber component having a JIS-A hardness of 15° or lower, and the surface layer is made of a surface layer forming material that has an elongation (Eb) according to JIS K6251 of 5 to 90% and a tensile strength (TS) of 35 MPa or higher.

Examples of the image carrier used in the image forming apparatus described above include an inorganic photoreceptor that has a photosensitive layer made of selenium or other inorganic material, and an organic photoreceptor that has a photosensitive layer consisting mainly of organic components such as a binder resin, a charge generating agent and a charge transport agent. Examples of the organic photoreceptor include a single layer type organic photoreceptor that has a photosensitive layer containing a charge generating agent and charge transport agent together. A single layer type organic photoreceptor that is charged positively is called "positively-charged single layer type electrophotographic photoreceptor."

The organic photoreceptors such as positively-charged single layer type photoreceptors are likely to have lower durability than the inorganic photoreceptors. In addition, compared to the non-contact charging type charging device, the contact charging type charging device tends to impose a larger load on its photoreceptor.

Although the conventional device described above is capable of obtaining copied or printed images of high quality over a long period of time, using the charging roller of the conventional device as a charging roller of a charging device for charging such a positively-charged single layer type electrophotographic photoreceptor is not enough to form images of sufficiently high quality. Especially immediately after rotating the photosensitive drum for several tens of seconds without charging the photoreceptor, the charging performance of the photoreceptor drops significantly, and consequently fogging occurs if the image formation is continued.

An image forming apparatus with a plurality of photosensitive drums, such as a full-color image forming apparatus, tends to rotate the photoreceptors without charging the photoreceptors. The full-color image forming apparatus generally adopts a so-called tandem configuration in which black, cyan, magenta and yellow image forming units arranged therein form toner images, which are then primarily transferred to an intermediate transfer belt and then secondarily transferred to a sheet. These types of tandem image forming apparatuses include an inexpensive apparatus that is not equipped with a primary transfer roller release mechanism. In such an apparatus, color image photosensitive drums are rotated when forming a black-and-white image. In this case, the color image photoreceptors are not charged, which lowers the charging performance of the photoreceptors. This type of image forming apparatus cannot form images quickly because the photoreceptors need to be repeatedly charged and destaticized for several minutes in order to recover the charging performance of the photoreceptors.

SUMMARY OF THE INVENTION

An object of the present invention is to provide an image forming apparatus that has a plurality of image carriers configured by positively-charged single layer type electrophotographic photoreceptors and is capable of forming images of excellent quality even after executing an operation mode where none of the image carriers functions to form images.

An image forming apparatus according to one aspect of the present invention for accomplishing the abovementioned object includes: first and second image carriers that are configured by positively-charged single layer type electrophotographic photoreceptors; first and second developing devices that supply toner of developers to circumferential surfaces of the first and second image carriers respectively; first and second charging members that come into contact with the circumferential surfaces of the first and second image carriers, respectively, to charge the circumferential surfaces of the first and second image carriers; a voltage application portion that applies a charging bias to each of the first and second charging members; first and second destaticizing portions that destaticize the circumferential surfaces of the first and second image carriers respectively; an image carrier driving portion that rotates the first and second image carriers; and a controller that controls an operation for charging or destaticizing the circumferential surfaces of the first and second image carriers, wherein the controller switches between a first mode for operating the first developing device and the second developing device while rotating the first image carrier and the second image carrier so as to form an image on both the first image carrier and the second image carrier, and a second mode for operating only the first developing device while rotating the first image carrier and the second image carrier so as to form an image only on the first image carrier; and in the second mode, applies the charging bias and operates the second destaticizing portion for the second image carrier without operating the second developing device, and applies the charging bias and operates the first developing device and the first destaticizing portion for the first image carrier.

Further objects and specific advantages provided by the present invention will be clarified by the following descriptions of embodiments.

DETAILED DESCRIPTION OF THE PREFERRED EMBODIMENTS

An image forming apparatus according to embodiments of the present invention is now described hereinafter in detail with reference to the drawings. Hereinbelow, a tandem image forming apparatus is described as an example of the image forming apparatus. A color printer is also described as an example of the image forming apparatus, but the type of the image forming apparatus is not limited to the color printer and can be, for example, a copy machine, a fax machine, and a complex machine.

Figure 1:
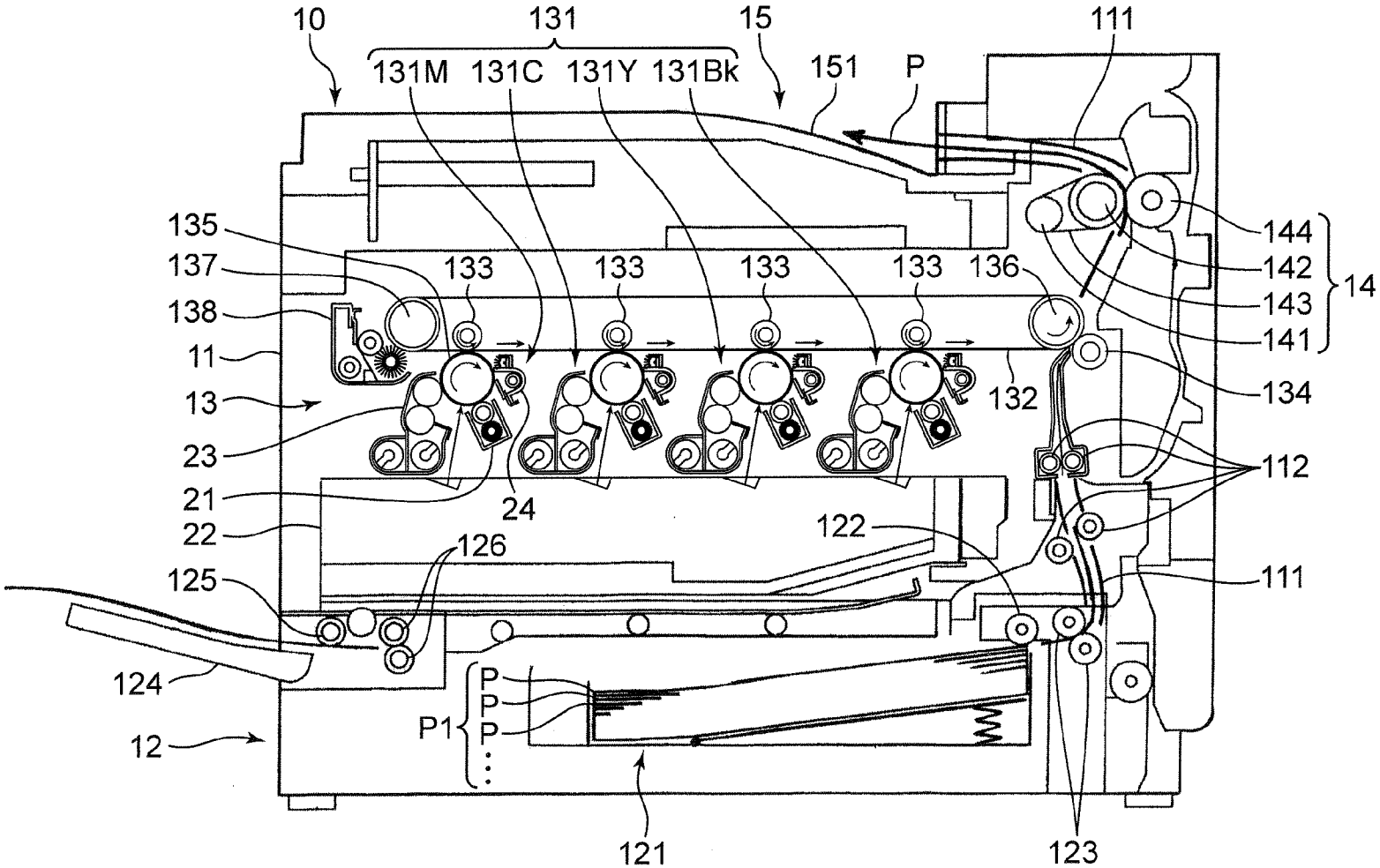
FIG. 1 is a schematic cross-sectional diagram showing the entire configuration of an image forming apparatus according to an embodiment of the present invention.

An image forming apparatus 10 has a box-shaped apparatus main body 11 as shown in FIG. 1. The inside of the apparatus main body 11 is provided with a sheet feeding portion 12 for feeding sheets P, an image forming portion 13 that forms a toner image based on image information to each of the sheets P while conveying the sheets P fed from the sheet feeding portion 12, and a fixing portion 14 that performs a fixing process for fixing this unfixed toner image, formed by the image forming portion 13, onto each sheet P. An upper part of the apparatus main body 11 has a sheet discharge portion 15 that discharges the sheets P subjected to the fixing process by the fixing portion 14.

An operation panel, not shown, for inputting output conditions for outputting the sheets P is provided in an appropriate section on an upper surface of the apparatus main body 11. The operation panel is provided with a power key and various other keys for inputting the output conditions.

Within the apparatus main body 11, there is a sheet conveying path 111 that extends in a vertical direction is formed on the right-hand side of the image forming portion 13 shown in FIG. 1. A conveying roller pair 112 is provided in an appropriate section of the sheet conveying path 111. The sheet conveying path 111 uses the conveying roller pair 112 to convey the sheets P from the sheet feeding portion 12 to the sheet discharge portion 15, wherein the sheets P being conveyed pass through a transfer portion of the image forming portion 13 or the fixing portion 14.

The sheet feeding portion 12 has a sheet feeding tray 121, a pickup roller 122, and a sheet feeding roller pair 123. The sheet feeding tray 121 is installed under the image forming portion 13 of the apparatus main body 11 so as to be detachable and to accommodate a pile of sheets P1, a stack of the plurality of sheets P. The pickup roller 122 is provided in the upper right position of the sheet feeding tray 121 in FIG. 1 and in an upstream position of a conveying direction for conveying the sheets P, and picks up the sheets P on the sheet feeding tray 121 from the top of the pile of sheets P1, one by one. The sheet feeding roller pair 123 sends the sheets P picked up by the pickup roller 122, to the sheet conveying path 111. In this manner, the sheet feeding portion 12 feeds the sheets P toward the image forming portion 13.

The sheet feeding portion 12 further has a manual tray 124 attached to a left side surface of the apparatus main body 11 as shown in FIG. 1, a pickup roller 125, and a sheet feeding roller pair 126. The manual tray 124 is used for supplying the sheets P manually to the image forming portion 13. The manual tray 124 can be stored on a side of the apparatus main body 11. When feeding the sheet P manually, the manual tray 124 is pulled out from the side of the apparatus main body 11, as shown in FIG. 1, so that the sheets P can be fed manually. The pickup roller 125 picks up the sheets P placed on the manual tray 124. The sheets P picked up by the pickup roller 125 are sent to the sheet conveying path 111 by the sheet feeding roller pairs 123, 126. In this manner, the sheet feeding portion 12 feeds the sheets P toward the image forming portion 13.

The image forming portion 13 performs a predetermined image process to form images, such as color images, on the sheets P that are fed from the sheet feeding portion 12. The image forming portion 13 has a plurality of image forming units 131, an intermediate transfer belt 132, a primary transfer roller 133, and a secondary transfer roller 134.

In the present embodiment, the image forming units 131 are disposed sequentially from an upstream position of a rotation direction of the intermediate transfer belt 132 toward a downstream position of the same (from the left to the right in FIG. 1), and include a magenta (M) unit 131M that uses a magenta developer, a cyan (C) unit 131C that uses a cyan developer, a yellow (Y) unit 131Y that uses a yellow developer, and a black (Bk) unit 131Bk that uses a black developer. Each image forming unit 131 has a photosensitive drum 135 serving as an image carrier (a Bk photosensitive drum 135 serves as a first image carrier, and M, C, Y color photosensitive drums 135 as second image carriers). The image forming units 131 form, on the photosensitive drums 135, toner images of the respective colors based on image formation and primarily transfer the toner images to the intermediate transfer belt 132. A configuration of each image forming unit 131 is described hereinbelow.

The intermediate transfer belt 132 is configured to receive the transferred (primary transferred) toner images based on the image information that are formed on circumferential surfaces (contact surfaces) thereof by the plurality of image forming units 131. In other words, in the present embodiment, the intermediate transfer belt 132 is a transferred body that is held between each photosensitive drum 135 and the primary transfer roller 133 and has a circumferential surface to which a toner image is transferred from the photosensitive drum 135.

The intermediate transfer belt 132, an endless belt-like rotating body, is wrapped around a driving roller 136 and a driven roller 137 in a manner that a circumferential surface of the intermediate transfer belt 132 abuts on the circumferential surface of each photosensitive drum 135. The intermediate transfer belt 132 is endlessly rotated by the rotary drive of the driving roller 136 while being pressed against each photosensitive drum 135 by each primary transfer roller 133 that faces the corresponding photosensitive drum 135 with the intermediate transfer belt 132 therebetween. The driving roller 136 is driven to rotate by a drive source such as a stepping motor, to provide drive force for endlessly rotating the intermediate transfer belt 132. The driven roller 137 is rotatably provided and driven as the intermediate transfer belt 132 is endlessly rotated by the driving roller 136.

The primary transfer rollers 133 primarily transfer the toner image on the respective photosensitive drums 135 to the intermediate transfer belt 132. In other words, in the present embodiment, the primary transfer rollers 133 are transfer portions that hold the intermediate transfer belt 132 with the respective photosensitive drums 135 and primarily transfer the toner images on the photosensitive drums 135 to the intermediate transfer belt 132.

The primary transfer roller 133 is disposed facing the corresponding photosensitive drum 135, with the intermediate transfer belt 132 therebetween. The primary transfer roller 133 is provided for each photosensitive drum 135 of the corresponding image forming unit 131. As described above, the primary transfer roller 133 is in contact with the intermediate transfer belt 132 so that the intermediate transfer belt 132 is pressed against the photosensitive drum 135. In addition, while in contact with the intermediate transfer belt 132, the primary transfer roller 133 is rotated as the intermediate transfer belt 132 is endlessly rotated. In this case, by applying a primary transfer bias voltage having a polarity opposite to a toner charging polarity to each primary transfer roller 133, the toner image on each photosensitive drum 135 is primarily transferred to the intermediate transfer belt 132 between each photosensitive drum 135 and the corresponding primary transfer roller 133. Consequently, the toner image on the respective photosensitive drums 135 are sequentially transferred to the intermediate transfer belt 132 that turns in a direction of an arrow (counterclockwise, in FIG. 1), in superimposed manner.

Figure 2:
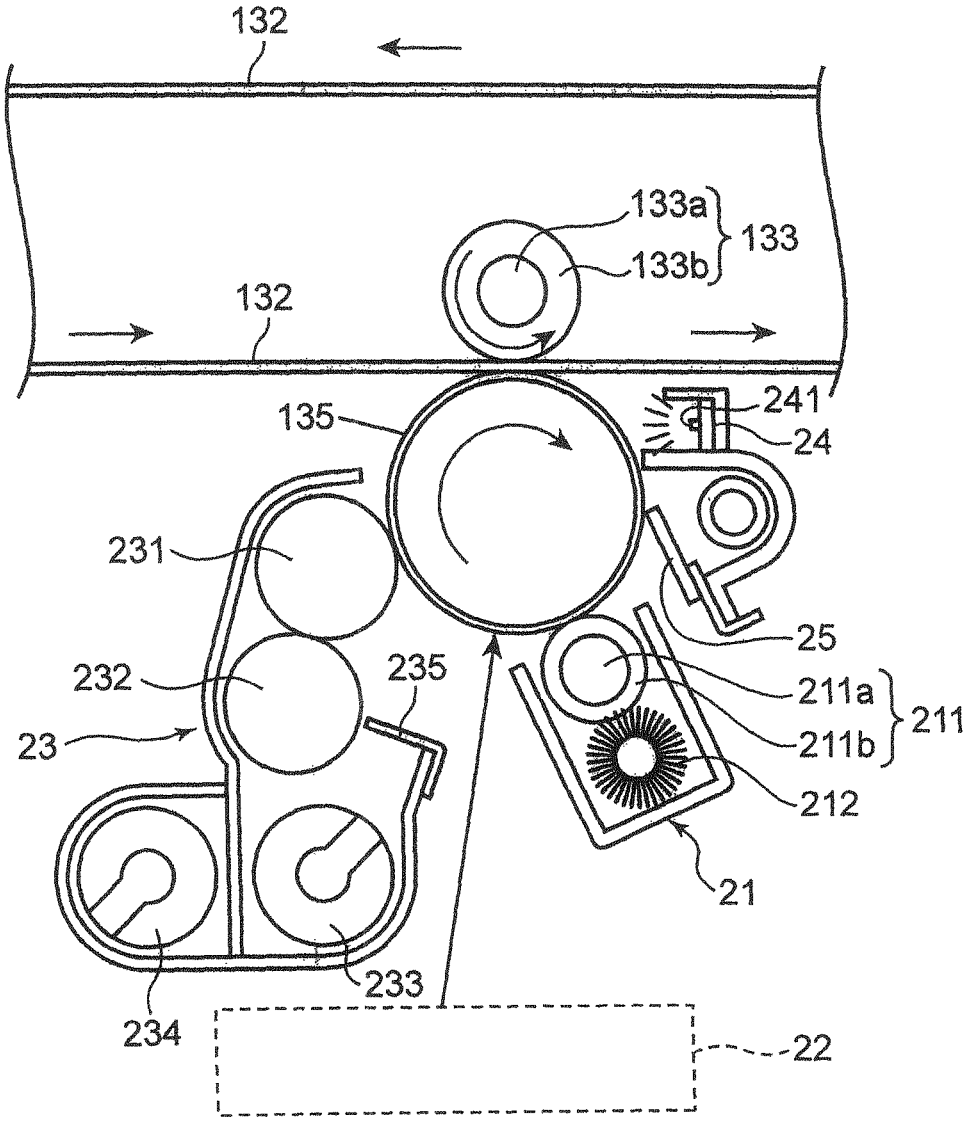
FIG. 2 is a schematic cross-sectional diagram showing an enlarged view of a periphery of an image forming unit of the image forming apparatus.

The primary transfer rollers 133 are not particularly limited as long as the primary transfer described above can be performed. In the present embodiment, each primary transfer roller 133 has, as shown in FIG. 2, a cored bar 133*a* supported rotatably, a surface part 133*b* that covers the cored bar 133*a* and comes into contact with the intermediate transfer belt 132, and a primary transfer bias voltage application portion, not shown, for applying the primary transfer bias voltage to the cored bar 133*a*. In the present embodiment, the cored bar 133*a* is a part to which the primary transfer bias voltage is applied. Note that FIG. 2 is a schematic cross-sectional diagram showing an enlarged view of periphery of one of the image forming units 131 of the image forming apparatus 10 according to the present embodiment.

The secondary transfer roller 134 transfers the toner images on the intermediate transfer belt 132 to the sheet P fed from the sheet feeding portion 12 (secondary transfer). In the present embodiment, the secondary transfer roller 134 comes into contact with the circumferential surface of the intermediate transfer belt 132 to form a nip portion therebetween. This nip portion is a secondary transfer portion for secondarily transferring the toner images on the circumferential surface of the intermediate transfer belt 132 to the sheet P, which is a recording medium passing through the nip portion.

The secondary transfer roller 134 is disposed facing the driving roller 136 with the intermediate transfer belt 132 therebetween, and is rotated as the intermediate transfer belt 132 is endlessly rotated, while in contact with the intermediate transfer belt 132. In this case, a secondary transfer bias voltage having a polarity opposite to the toner charging polarity is applied to the secondary transfer roller 134. Consequently, the toner images that are primarily transferred to the intermediate transfer belt 132 are secondarily transferred to the sheet P fed from the sheet feeding portion 12, between the secondary transfer roller 134 and the driving roller 136. As a result, the toner images based on image information are transferred to the sheet P before being fixed.

The image forming unit 13 further has a belt cleaning device 138 at a position downstream of the rotation direction of the intermediate transfer belt 132 from a secondary transfer position, the downstream position being an upstream position in the rotation direction from the primary transfer position. The belt cleaning device 138 cleans the intermediate transfer belt 132 by removing the toner remaining on the circumferential surface of the intermediate transfer belt 132 after the secondary transfer. The circumferential surface of the intermediate transfer belt 132 cleaned by the belt cleaning device 138 is then directed toward a new primary transfer position. The waste toner removed by the belt cleaning device 138 is collected and kept in a toner recovery bottle, not shown, through a predetermined path.

The fixing portion 14 performs the fixing process on the toner images that are transferred onto the sheet P by the image forming unit 13. The fixing portion 14 has a heat roller 141 having an electric heat generating element therein, which is a heat source, a fixing roller 142 disposed facing the heat roller 141, a fixing belt 143 stretched between the fixing roller 142 and the heat roller 141, and a pressure roller 144 disposed facing the other side of the fixing roller 142 with the fixing belt 143 therebetween.

The sheet P supplied to the fixing portion 14 passes through a fixing nip portion formed between the fixing belt 143 and the pressure roller 144, to be heated and pressurized. As a result, the toner images that are transferred to the sheet P by the image forming unit 13 are fixed to the sheet P. The sheet P that is finished with the fixing process is then discharged toward a discharge tray 151 of the sheet discharge portion 15 via the sheet conveying path 111 extending from an upper part of the fixing portion 14, the discharge tray 151 being provided at a top part of the apparatus main body 11.

The sheet discharge portion 15 includes the discharge tray 151 that is formed into a concave shape at the top part of the apparatus main body 11. The discharge tray 151 receives the sheet P that is discharged at a bottom part of this concave portion.

The image forming units 131 are described next. In a central position of each image forming unit 131, the photosensitive drum 135 serving as an image carrier is disposed so as to be able to rotate in a direction of an arrow (clockwise in FIG. 2). Suppose that each position where the toner image is transferred by the primary transfer roller 133 (primary transfer) is the uppermost position of a direction of rotation of the photosensitive drum 135. From this position toward the downstream side, a destaticizing device 24, cleaning device 25, charging device 21, exposure device 22, and developing device 23 are disposed around the periphery of the photosensitive drum 135, these devices corresponding to a destaticizing position, a cleaning position, a charging position, an exposure position, and a developing position, respectively.

The photosensitive drum 135 forms on the circumferential surface thereof a toner image of the corresponding color based on the image information, by undergoing a charging process, an exposure process, a developing process, a destaticizing process, and a cleaning process, which are described hereinafter. A positively-charged single layer type electrophotographic photoreceptor, which is described hereinafter, is used as each photosensitive drum 135.

The charging device 21 charges the circumferential surface of the corresponding photosensitive drum 135 that is rotated in the direction of the arrow. A contact type charging device is used as the charging device 21. The contact type charging device charges the circumferential surface of the photosensitive drum 135 by coming into contact with the circumferential surface of the photosensitive drum 135, so as to produce a smaller amount of ozone, compared to a non-contact type charging device.

The charging device 21 is not particularly limited as long as it is the contact type charging device, and, in the present embodiment, has a charging roller 211 (the first or second charging member) that comes into contact with the circumferential surface of the photosensitive drum 135, and a charging cleaning brush 212 for removing the toner adhered to the charging roller 211.

The charging roller 211 is a charging member for charging the circumferential surface of the photosensitive drum 135 while in contact with the circumferential surface of the photosensitive drum 135. Although not particularly limited, the charging roller 211 of the present invention has a cored bar 211*a* supported rotatably, a surface part 211*b* that covers the cored bar 211*a* and comes into contact with the photosensitive drum 135, and a charging bias voltage application portion, not shown, for applying a charging bias voltage to the cored bar 211*a*, as shown in FIG. 2. The charging roller 211 rotates as the photosensitive drum 135 rotates, while in contact with the photosensitive drum 135. In this case, the circumferential surface of the photosensitive drum 135 is charged by applying a charging bias voltage to the cored bar 211*a* of the charging roller 211.

The surface part 211*b*, which is a section on the charging roller 211 that comes into contact with the circumferential surface of the photosensitive drum 135, preferably has an Asker-C rubber hardness of 30 to 80° or more preferably 65 to 75°. When the surface part 211*b* is excessively soft, uniform chargeability enough for the charging roller of the contact type charging device to function cannot be obtained. When the surface part 211*b* is excessively hard, uneven charging might occur. Therefore, with the surface part 211*b* having a hardness within the ranges described above, high-quality images can be obtained, and damage to the photosensitive drum 135 can be prevented. The rubber hardness can be measured using a well-known method.

When the section that comes into contact with the photosensitive drum 135 is as relatively soft and has an Asker-C rubber hardness of 30 to 80°, the photosensitive drum 135 can be prevented from being damaged. Such a soft section coming into contact with the photosensitive drum 135 is considered to be able to obtain a wide region where electricity can be discharged between a circumferential surface of the charging roller 211 and the circumferential surface of the photosensitive drum 135 when the charging roller 211 and the photosensitive drum 135 approach each other, the region contributing to the charging of the circumferential surface of the photosensitive drum 135. For this reason, the circumferential surface of the photosensitive drum 135 can be charged suitably.

Although not particularly limited, the layer thickness of the surface part 211*b* is preferably, for example, 1 to 3 mm.

Materials constituting the surface part 211*b* are not particularly limited as long they can constitute the surface part 211*b* of the charging roller 211. Specific examples of the materials include a material that is obtained by adding an electrical conductive material such as a carbon to epichlorohydrin rubber, urethane rubber, silicone rubber, nitrile rubber (NBR), and chloroprene (CR) rubber. Above all, a material obtained by adding an electrical conductive material such as the carbon to epichlorohydrin rubber and nitrile rubber (NBR) is preferred due to their resistance to ozone, low-temperature characteristics and electric conductive uniformity (the difference in resistance is small depending on places).

In the present embodiment, the surface roughness of the charging roller 211 is preferably such that the average distance (Sm) between asperity peaks on a cross-sectional curve is 50 to 100 μm and that the ten-point height irregularities (Rz) is 8 to 20 μm. Such a configuration can adequately prevent uneven charging as well as the occurrence of peeling of a film of a photosensitive layer. It should be noted that the average distance (Sm) between asperity peaks on a cross-sectional curve and the ten-point height irregularities (Rz) can be measured using a well-known method.

The charging device 21 preferably charges the circumferential surface of the photosensitive drum 135 so that a surface potential of each photosensitive drum 135 becomes 500 V or higher. Excessively low surface potential causes noticeable uneven charging showing a slight change in surface potential, causing fogging and the like. High-quality images can be formed by charging the photosensitive drums 135 in the manner described above. As long as the photosensitive layer of each photosensitive drum 135 is not destroyed, uneven charging can be prevented by charging the circumferential surface of the photosensitive drum 135 so that the surface potential thereof becomes significantly high and falls within the range mentioned above. In addition, because an organic photoreceptor such as a positively-charged single layer type electrophotographic photoreceptor is used as an image carrier in the present embodiment, it is preferred that the circumferential surface of the photosensitive drum 135 be charged so that the surface potential thereof becomes 600 V or less, without destroying the photosensitive layer.

The charging bias voltage that is applied by the charging bias voltage application portion of the charging device 21 is preferably 1000 V or higher. Excessively low charging bias voltage leads to an excessively low surface potential of the photosensitive drum 135, causing noticeable uneven charging showing a slight change in surface potential, as well as fogging and the like. High-quality images can be formed by applying the charging bias voltage mentioned above. As long as the photosensitive layer of each photosensitive drum 135 is not destroyed, uneven charging can be prevented by charging the circumferential surface of the photosensitive drum 135 so that the surface potential thereof becomes significantly high and falls within the range mentioned above.

The charging bias voltage is preferably a DC voltage only, so that the photosensitive layer can be made more resistant even when the positively-charged single layer type electrophotographic photoreceptor, described hereinafter, is used. More specifically, compared to when applying the charging roller with an AC voltage or a superimposed voltage in which an AC voltage is superimposed on a DC voltage, applying the charging roller only with a DC voltage can make the photosensitive layer more resistant.

Generally speaking, although the application of an AC voltage can uniform the potential of the surface (circumferential surface) of the photosensitive drum 135 by charging the surface of the photosensitive drum 135, the image forming apparatus of the present embodiment uses the contact type charging device in place of the non-contact type charging device so as to be able to charge the surface of each photosensitive drum 135 evenly with the application of a DC voltage alone. Therefore, the image forming apparatus can not only form excellent images by applying only a DC voltage to each charging roller, but also make the photosensitive layers more resistant.

The exposure device 22 irradiates the corresponding circumferential surface of the photosensitive drum 135, the circumferential surface of which is uniformly charged by the charging device 21, with a laser beam based on image data, and forms an electrostatic latent image based on the image information, on the circumferential surface of the photosensitive drum 135. Examples of the exposure device 22 include an LED head unit and a laser scanning unit (LSU).

Figure 3:
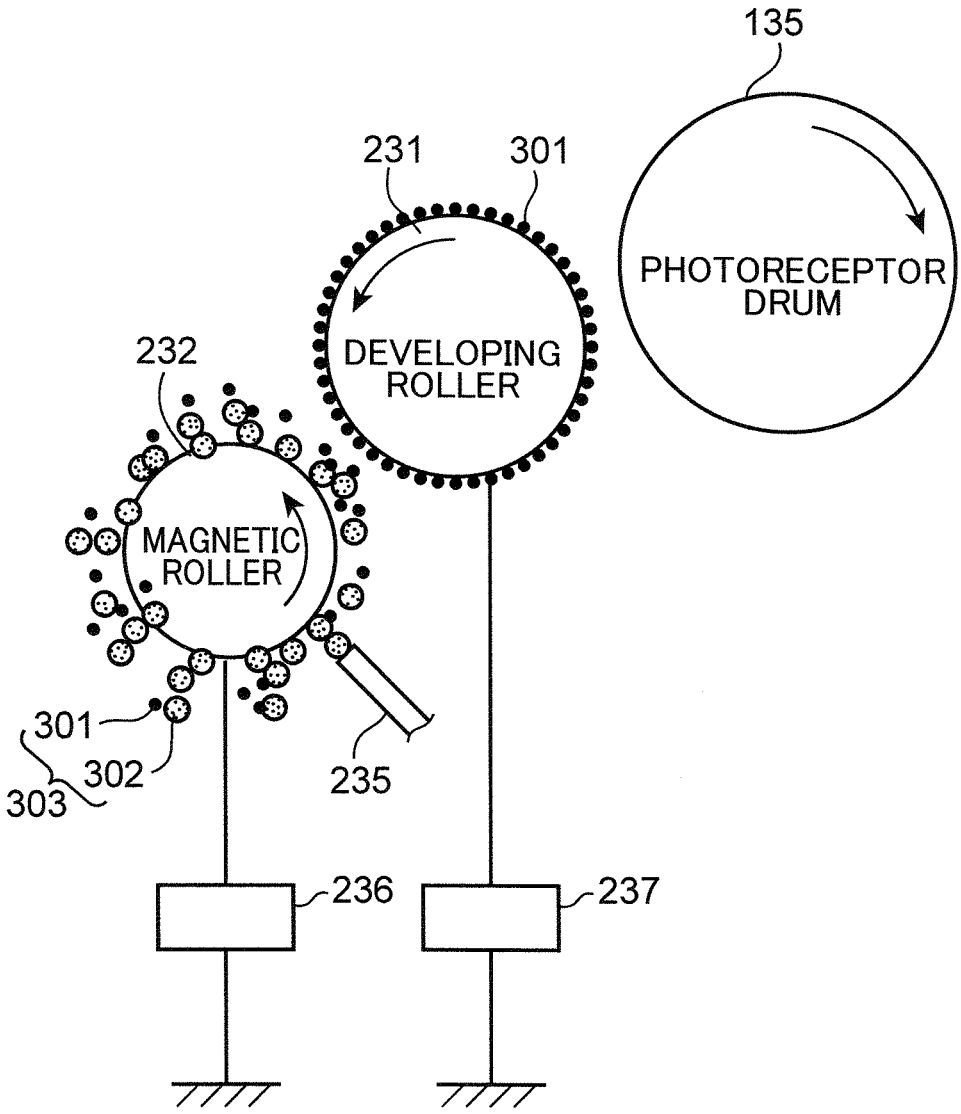
FIG. 3 is a conceptual diagram for illustrating how a developing device of the image forming apparatus develops an image.

The developing device 23 (the first and second developing devices) develops the electrostatic latent image on the circumferential surface of the photosensitive drum 135 into a toner image. The developing device 23 is described with reference to FIGS. 2 and 3. Note that FIG. 3 is a conceptual diagram for illustrating how the developing device 23 of the image forming apparatus 10 according to the present embodiment of the present invention performs image development, wherein the positional relation among the photosensitive drum 135, a developing roller 231, magnetic roller 232 and bristle cutting blade 235 is different than that shown in FIG. 2.

The developing device 23 has the developing roller 231, the magnetic roller 232, a paddle mixer 233, an agitating mixer 234, the bristle cutting blade 235, a toner supply bias voltage application portion 236, and a developing bias voltage application portion 237.

The developing roller 231 is disposed facing the corresponding photosensitive drum 135 and the magnetic roller 232, wherein the circumferential surface of the developing roller 231 is in proximity to, but away from, the circumferential surfaces of the photosensitive drum 135 and the magnetic roller 232. In other words, the developing roller 231 and the photosensitive drum 135 are disposed away from each other but the circumferential surfaces thereof are in proximity to each other. The circumferential surface of the developing roller 231 is in proximity to, but away from, the circumferential surface of the magnetic roller 232.

The magnetic roller 232 rotates by means of a magnet disposed therein, which carries a two-component developer containing the toners on the circumferential surface thereof, and conveys the developer to the vicinity of the developing roller 231. In this manner, the magnetic roller 232 supplies the toners of the two-component developer to the developing roller 231.

The developing roller 231 rotates while carrying, on the circumferential surface thereof, the toners supplied from the magnetic roller 232, and conveys the developer to the vicinity of the photosensitive drum 135. In this manner, the electrostatic latent image that is formed beforehand on the circumferential surface of the photosensitive drum 135 is made visible (developed) in the form of a toner image.

The paddle mixer 233 and the agitating mixer 234 with spiral blades agitate the two-component developer while conveying it in directions opposite to each other, thereby charging the toners contained in the two-component developer. Moreover, the paddle mixer 233 supplies the two-component developer containing the charged toners, to the magnetic roller 232.

The bristle cutting blade 235 is disposed such that a tip end thereof faces the circumferential surface of the magnetic roller 232, and serves to regulate the thickness of the two-component developer carried on the magnetic roller 232.

The toner supply bias voltage application portion 236 applies a toner supply bias voltage to the magnetic roller 232. By applying the toner supply bias voltage, the toner supply bias voltage application portion 236 causes the magnetic roller 232 to splash the toners of the two-component developer to the developing roller 231, the two-component developer being conveyed to the vicinity of the developing roller 231 by the magnetic roller 232.

The developing bias voltage application portion 237 applies a developing bias voltage to the developing roller 231. By applying the developing bias voltage, the developing bias voltage application portion 237 causes the developing roller 231 to splash the toners to the photosensitive drum 135, the toners being conveyed to the vicinity of the photosensitive drum 135.

More specifically, the toner image is developed as follows. A two-component developer 303 that contains a toner 301, which is charged by the paddle mixer 233 and the agitating mixer 234, and a carrier 302, is supplied to the magnetic roller 232. The two-component developer 303 supplied to the magnetic roller 232 is conveyed toward the developing roller 231 by the magnetic roller 232. The two-component developer 303 conveyed by the magnetic roller 232 passes through between the bristle cutting blade 235 and the magnetic roller 232 before being conveyed to the vicinity of the developing roller 231. As a result, the thickness of the two-component developer 303 is regulated. The toner supply bias voltage applied by the toner supply bias voltage application portion 236 generates a difference in potential between the developing roller 231 and the magnetic roller 232. When the two-component developer 303 is moved to the vicinity of the developing roller 231 after the thickness is regulated, only the charged toner 301 is moved to the developing roller 231 by the difference in potential. The toner 301 that is moved to the developing roller 231 forms an even toner layer.

Note that, for example, a developer that contains the toner 301 and the carrier 302 is used as the two-component developer 303. Examples of the toner 301 include a toner that is constituted by toner particles including a binder resin, a colorant and a parting agent, and an external additive that is externally added to the toner particles. A so-called nonmagnetic toner is preferably used as the toner 301. The carrier 302 of ferrite magnetic particles charges the toner 301. A predetermined amount of the carrier 302 is filled in the developing device 23 and the toner 301 is replenished from a toner cartridge, not shown, to the developing device 23 accordingly.

The developing bias voltage application portion 237 also generates a difference in potential between the photosensitive drum 135 and the developing roller 231. Therefore, when the toner on the developing roller 231 moves to the vicinity of the photosensitive drum 135, the toner 301 is splashed by this difference in potential and adheres to the electrostatic latent image formed on the circumferential surface of the photosensitive drum 135. This process is called nonmagnetic non-contact developing. In this manner, the developing device 23 can perform the development based on the electrostatic latent image.

The developing bias voltage application portion 237 has an AC power source for applying an AC voltage. In other words, the developing bias voltage applied by the developing bias voltage application portion 237 contains an AC component. The frequency of the AC component is preferably 2.6 to 4.2 kHz, so that images of sufficiently high quality can be formed over a long period of time. Specifically, images of sufficiently high quality can be formed even with the contact type charging device. The developing bias voltage application portion 237 may further have a DC power source for applying a DC voltage. In other words, the developing bias voltage applied by the developing bias voltage application portion 237 may be a superimposed voltage in which an AC component is superimposed on a DC component.

The developing bias voltage applied by the developing bias voltage application portion 237 is preferably the following voltage. The DC voltage applied by the DC power source (the voltage of the DC component of the developing bias voltage: Vdc) varies depending on the difference in rotational speed (circumferential speed ratio) between the photosensitive drum and the developing roller, but is preferably 300 V or lower. With such voltage, the toner remaining on the photosensitive drum without being transferred to the intermediate transfer belt can be removed easily, hysteresis hardly occurs, and application of a strong electric field to the toner can be prevented. In addition, a peak-to-peak value of the AC voltage applied by the AC power source (peak-to-peak value of the AC component of the developing bias voltage: Vpp) is preferably 1.3 to 1.7 kV.

The toner supply bias voltage application portion 236 has an AC power source for applying an AC voltage and a DC power source for applying a DC voltage. In other words, the toner supply bias voltage applied by the toner supply bias voltage application portion 236 is a superimposed voltage in which an AC component is superimposed on a DC component.

The toner supply bias voltage applied by the toner supply bias voltage application portion 236 is preferably the following voltage. The DC voltage applied by the DC power source (the voltage of the DC component of the toner supply bias voltage: Vdc) varies depending on the difference in rotational speed (circumferential speed ratio) between the magnetic roller and the developing roller, but is preferably 650 V or lower. Excessively low DC voltage makes the layer of toner formed on the developing roller too thin, and excessively high AC voltage makes the toner layer too thick. A peak-to-peak value of the AC voltage applied by the AC power source (peak-to-peak value of the AC component of the toner supply bias voltage: Vpp) is preferably 1.1 to 1.5 kV.

The destaticizing device 24 (first and second destaticizing portions) destaticizes the circumferential surface of the photosensitive drum 135 and the toner remaining thereon, after the primary transfer roller 133 transfers the toner on the circumferential surface of the photosensitive drum 135 to the intermediate transfer belt 132 (primary transfer). The destaticizing device 24 has a destaticizing lamp 241. Because the circumferential surface of the photosensitive drum 135 is charged, destaticization thereof can allow the cleaning device 25, described hereinafter, to suitably remove the toner remaining on the circumferential surface of the photosensitive drum 135.

The cleaning device 25 cleans the circumferential surface of the photosensitive drum 135 by removing the toner remaining thereon. Specific examples of the cleaning device 25 include a cleaning blade. The circumferential surface of the photosensitive drum 135 that is subjected to this cleaning process by the cleaning device 25 is then prepared for a new image forming process at the charging position. The waste toner removed by the cleaning device 25 is collected and kept in a toner recovery bottle, not shown, through a predetermined path.

Next is described operations performed by the charging device 21 and the destaticizing device 24 in the image forming apparatus 10 according to the present embodiment.

In some cases, the image forming apparatus 10 rotates the photosensitive drums 135 even when the respective image forming units 131 do not function to form images. More specifically, of the magenta unit 131M, the cyan unit 131C, the yellow unit 131Y and the black unit 131Bk, even when some of the units 131 function to form images and some do not, the photosensitive drums 135 of the units 131 that do not function to form images are rotated as the intermediate transfer belt 132 is rotated.

For example, when executing black-and-white printing, the black unit 131Bk is operated to form an image using a black (Bk) toner (achromatic toner) of a black developer. In so doing, the color image forming units, such as the magenta unit 131M, the cyan unit 131C and the yellow unit 131Y, are not operated since color toners (chromatic toners) in respective colors (chromatic) developers are used for forming an image. However, with the operation of the black unit 131Bk, the intermediate transfer belt 132 is rotated, whereby the photosensitive drums 135 of the color image forming units are also rotated accordingly. In this case, although the photoreceptor drums 135 of the color image forming units are rotated, the developing devices 23 of the color image forming units are not operated (second mode).

When the photosensitive drums 135 of the units 131 that do not perform image formation are rotated, the time required for forming a suitable image might be lengthened after starting an image forming operation. The inventors of the present inventions speculate that the reasons thereof are as follows. First, when the photosensitive drums 135 are rotated, the non-contact objects such as the charging roller 211 of the charging device 21 and the cleaning device 25 are also rotated while in contact with the circumferential surfaces of the photosensitive drums 135. When the photosensitive drums 135 are rotated while in contact with the non-contact objects as described above, the charging performance of the photosensitive drums 135 deteriorate, and consequently the circumferential surfaces of the photosensitive drums 135 cannot be charged easily. Especially immediately after starting the image forming operation, the circumferential surfaces of the photosensitive drums 135 cannot be charged easily. Even when such photosensitive drums 135 with deteriorated charging performance are charged under the charging conditions in a normal charging time, the circumferential surfaces of such photosensitive drums 135 cannot be charged sufficiently to obtain a predetermined surface potential. Suitable images cannot be formed especially immediately after starting the image forming operation. Therefore, a pre-charging time in which the predetermined surface potential is obtained is lengthened, and a time in which suitable images can be formed after starting the image forming operation is lengthened.

In the present embodiment, therefore, the charging devices 21 and the destaticizing devices 24 of the units 131 that do not perform image formation also are operated. In other words, even when none of the developing devices 23 are operated, a charging bias voltage application portion 53, described hereinafter, applies a charging bias voltage to each cored bar 211*a* of the charging roller 211 and turns the destaticizing lamp 241 of the destaticizing device 24 ON. In this manner, high-quality images can be formed within a short period of time after the image forming operation is started. In the units 131 that do not perform image formation as well, charging and destaticization are carried out on the photosensitive drums 135 so as not to lower the charging performance of the photosensitive drums 135.

The above has focused on the operations performed by the color image forming units when printing a black-and-white image and a color image. When printing a black-and-white image using the image forming apparatus 10, the color image forming units do not perform image formation.

Specifically, the image forming apparatus 10 has, as the photosensitive drums 135, a black photoreceptor provided in the black unit 131Bk and color photoreceptors provided in the color image forming units. The image forming apparatus 10 also has, as the developing devices 23, a black developing device for supplying the black toner to the circumferential surface of the black photosensitive drum, and color developing devices for supplying the color toners to the circumferential surfaces of the color photosensitive drums.

Figure 4:
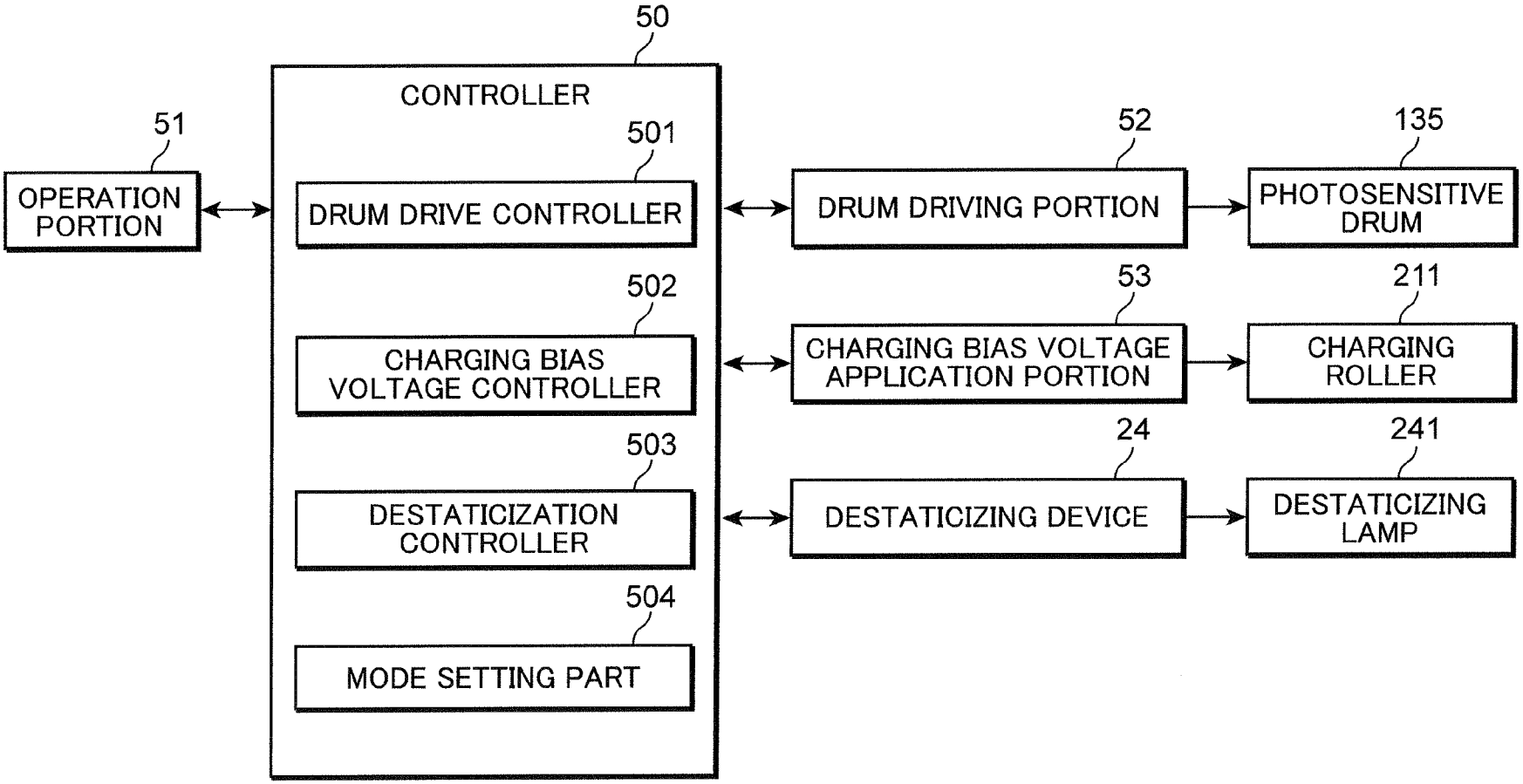
FIG. 4 is a block diagram showing an electrical configuration of the image forming apparatus.

Next is described an electrical configuration of the image forming apparatus 10. FIG. 4 is a block diagram showing the electrical configuration of the image forming apparatus 10 according to an embodiment of the present invention.

The image forming apparatus 10 has, as described above, the photosensitive drums 135, the charging rollers 211, the destaticizing device 24 having the destaticizing lamps 241, a controller 50, an operation portion 51, drum driving portions 52 (image carrier driving portion), and the charging bias voltage application portion 53 (voltage application portion).

The operation portion 51 has a power key, a start button, and setting keys for setting various functions, and outputs an operation signal to the controller 50.

The drum driving portions 52 provide the photosensitive drums 135 with rotary drive force. In the present embodiment, because the photosensitive drums 135 are rotated by the rotation of the intermediate transfer belt 132, each of the drum driving portions 52 corresponds to the driving roller 136.

The controller 50, constituted by a CPU (Central Processing Unit), executes a process based on a predetermined program in response to an input instruction signal, and integrally controls the image forming apparatus 10 by outputting an instruction signal to each function and transferring data. The controller 50 has various controllers for controlling functional portions required for carrying out a normal image forming process. In the present embodiment, the controller 50 has a drum drive controller 501, a charging bias voltage controller 502, a destaticization controller 503, and a mode setting part 504, in order to control the operation for charging or destaticizing the circumferential surface of each photosensitive drum 135.

The drum drive controller 501 operates the drum driving portions 52 so as to rotate the photosensitive drums 135 at predetermined timing. The predetermined timing here means when printing a black-and-white image, when replenishing toners into the developing devices 23 outside of image formation, and when cleaning the circumferential surfaces of the photosensitive drums 135 using the cleaning devices 25.

The charging bias voltage controller 502 controls the charging bias voltage that is applied to each cored bar 211*a* of the charging roller 211 by the charging bias voltage application portion 53.

The destaticization controller 503 controls the destaticizing devices 24. More specifically, the destaticization controller 503 controls the timing for turning the destaticizing lamps 241 of the destaticizing devices 24 ON.

The mode setting part 504 sets an image forming mode based on the image information. More specifically, when forming an image using the chromatic toners, the mode setting part 504 operates the black developing device and the color developing devices while rotating the black photosensitive drum and the color photosensitive drums, to set the image forming mode to a color mode (first mode) for causing the black photosensitive drum and the color photosensitive drums to form the image. When forming an image using the achromatic toner alone, the mode setting part 504 operates the black developing device only, while rotating the black photosensitive drum and the color photosensitive drums, to set the image forming mode to a black-and-white mode (second mode) for causing only the black photosensitive drum to form the image. In other words, the image forming apparatus 10 is capable of using the mode setting part 504 to switch between the color mode and the black-and-white mode based on the image information.

In the black-and-white mode, regardless of whether the color photosensitive drums function to form images, the controller 50 executes charging/destaticization control for the charging devices 21 and the destaticizing devices 24 of the color photosensitive drums and also operating the charging device 21, the developing device 23 and the destaticizing device 24 of the black photosensitive drum.

Figure 5:
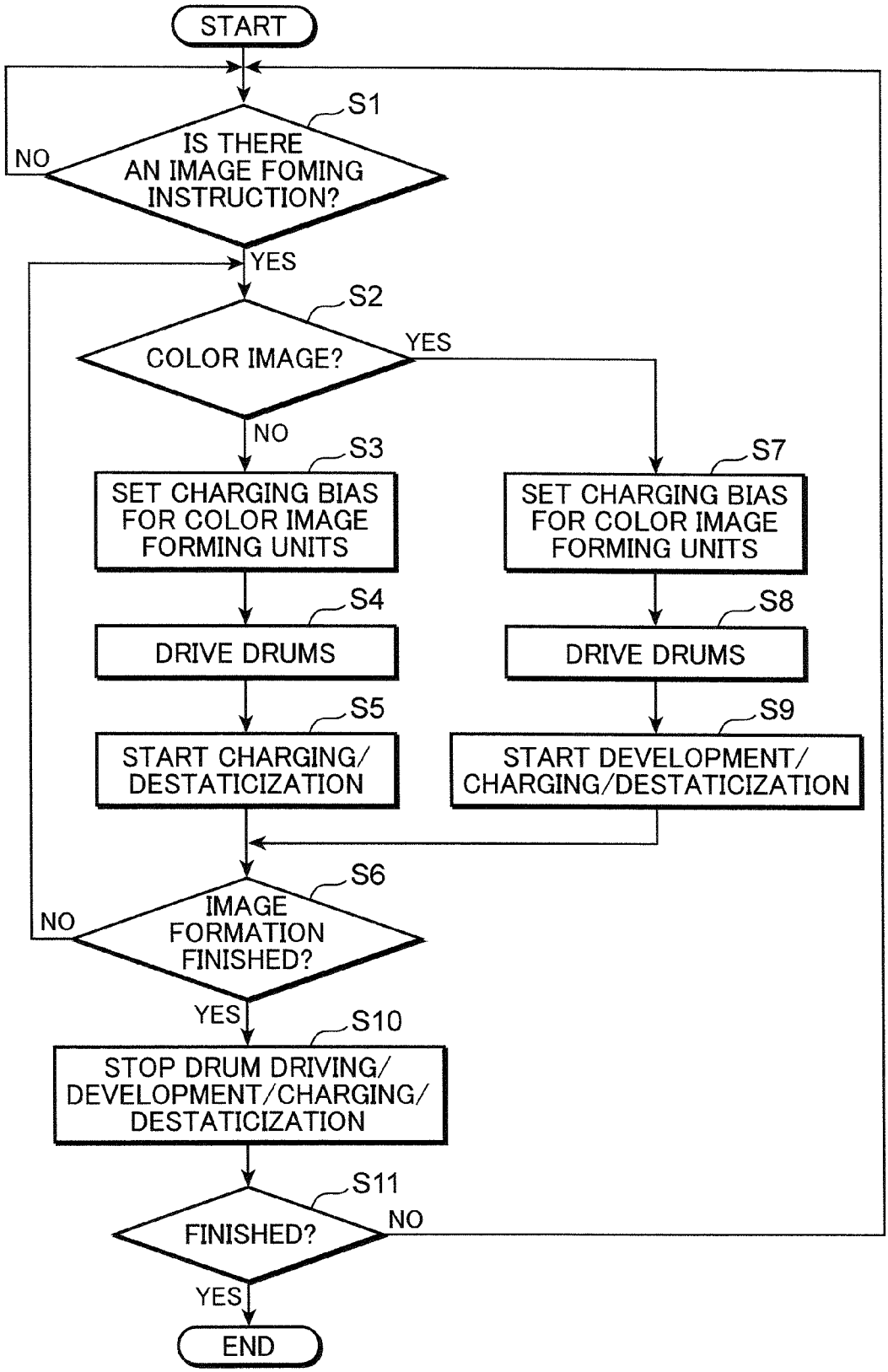
FIG. 5 is a flowchart for illustrating an image forming operation performed by a color image forming unit of the image forming apparatus.

Next is described an image forming operation performed by the color image forming units of the image forming apparatus 10. FIG. 5 is a flowchart for illustrating the image forming operation performed by the color image forming units of the image forming apparatus 10 according to an embodiment of the present invention.

First, the controller 50 checks whether there is an image forming instruction (step S1). When there are not image forming instructions, the controller 50 enters a standby mode (NO in step S1). When there is an image forming instruction, the controller 50 checks whether an image to be formed based on the image information telegraphed from an external device or the like is a color image or not (step S2). When this image is a color image, the mode setting part 504 sets the image forming mode to the color mode, and when the image is a black-and-white image, the mode setting part 504 sets the image forming mode to the black-and-white mode. In the color mode, the color image forming units function to form images. In the black-and-white mode, the color image forming units do not function to form images.

When the image forming mode is set to the black-and-white mode by the mode setting part 504 (NO in step S2), the charging bias voltage controller 502 sets the charging bias voltage that is applied to each cored bar 211*a* of the charging roller 211 by the charging bias voltage application portion 53 (step S3). In so doing, the charging bias voltage set in each of the color image forming units is preferably set to be lower than the charging bias voltage that is applied when the color image forming units function to form images, i.e., the normal charging bias voltage applied in the color mode. This is because the peeling of the film of the circumferential surface of each color photosensitive drum can be prevented as much as possible, saving the electric power.

Next, the drum drive controller 501 drives and rotates the photosensitive drums 135 (step S4). Subsequently, the charging bias voltage controller 502 causes the charging devices 21 to start charging the circumferential surfaces of the photosensitive drums 135, and the destaticization controller 503 causes the destaticizing devices 24 to start destaticizing the circumferential surfaces of the photosensitive drums 135 (step S5). At this point, the controller 50 does not cause the developing devices 23 to carry out the developing. The controller 50 then checks whether the image formation is finished or not (step S6). When the image formation is not yet finished (NO in step S6), the controller 50 returns to the step of checking whether the image to be formed is a color image or not (returns to step S2).

When the mode setting part 504 sets the image forming mode to the color mode (YES in step S2), the controller 50 causes the color image forming units to perform the normal operation. More specifically, the charging bias voltage controller 502 sets the charging bias voltage that is applied to each cored bar 211*a* of the charging roller 211 by the charging bias voltage application portion 53 (step S7). Next, the drum drive controller 501 drives and rotates the photosensitive drum 135 (step S8). The controller 50 then causes the developing devices 23 to carry out the development, and the charging bias voltage controller 502 causes the charging devices 21 to start charging the circumferential surfaces of the photosensitive drums 135. Furthermore, the destaticization controller 503 causes the destaticizing devices 24 to start destaticizing the circumferential surfaces of the photosensitive drums (step S9). The controller 50 then checks whether the image formation is finished or not (step S6). When the image formation is not yet finished (NO in step S6), the controller 50 returns to the step of checking whether the image to be formed is a color image or not (returns to step S2).

When the image formation is finished (YES in step S6), the controller 50 finishes driving, developing, charging and destaticizing the photosensitive drums 135 (step S10). Subsequently, the controller 50 checks the presence/absence of a signal for turning the power of the image forming apparatus 10 ON/OFF, the signal being sent from the operation portion 51 or the external device (step S11). When the presence of the ON signal is checked, the controller 50 returns to the step of determining the presence/absence of the image forming instruction (returns to step S1). When the presence of the OFF signal is checked, the controller 50 finishes the operations of the image forming apparatus 10.

The charging bias voltage that is set in the color mode is set to the charging bias voltage at which the surface potential of each photosensitive drum 135 becomes a potential suitable for performing the image formation by the charging bias voltage controller 502. In this case, the charging bias voltage becomes higher than the normal charging bias voltage in the color mode immediately after forming a black-and-white image. Thereafter, the charging bias voltage is preferably set to gradually decrease to the normal charging bias of the color mode. Therefore, even when the charging performance of the photosensitive drums 135 of the color image forming units becomes somewhat low when printing a black-and-white image, a color image of sufficiently high quality can be formed within a short period of time by using the color image forming units.

The positively-charged single layer type electrophotographic photoreceptor used as each photosensitive drum 135 in the present embodiment is not particularly limited as long as it can be suitably applied to the image forming apparatus having the contact type charging device described above. More specifically, the present embodiment suitably uses a photoreceptor, which, for example, has a conductive base substrate and a photosensitive layer, wherein the photosensitive layer contains a charge generating agent, a charge transport agent and a binder resin together, and the binder resin has a yield point strain of 9 to 29%. In addition, it is more preferred to use a photoreceptor in which the photosensitive layer has a yield point strain of 5 to 25%. Even in the image forming apparatus having the contact type charging device that is likely to impose a great load on the image carriers, use of such a photoreceptor can make the photosensitive layer more resistant. In addition, use of such a photoreceptor can also prevent the deterioration of the charging performance of each photosensitive drum, which might occur when each image carrier is rotated other than when forming an image. Therefore, even when using the contact type charging device capable of adequately preventing the ozone generation, the time in which a high-quality image is formed can be shortened.

The yield point strain is now described. Both ends of each sample material are fixed to each other at their ends by using two zippers. The samples are stretched by moving one of the zippers at a constant speed, to detect stress. When illustrating a stress-strain relationship using a curve, the strain and the stress are in a proportionate relationship, in which the samples become loose due to viscous components thereof as the strain increases, thereby obtaining a maximal value of the stress. This point is the yield point. The yield point strain is a value representing the degree of the strain on each sample at the yield point. In the present embodiment, the yield point can be measured by a well-known method.

The image forming apparatus 10 according to the present embodiment described above can form high-quality images within a short period of time after starting the image forming operation. In other words, because the color photosensitive drums (second image carriers) are charged and destaticized in the black-and-white mode (second mode), the charging performance of the second image carriers is prevented from being deteriorated. Therefore, even when the mode is switched to the first mode immediately after the execution of the second mode, high-quality images can be obtained promptly. Thus, in the image forming apparatus that has a plurality of image carriers configured by the positively-charged single layer type electrophotographic photoreceptors, high-quality images can always be formed within a short period of time, even after executing the operation mode in which not all image carriers function to form images.

The present invention is not limited to the embodiments described above, and therefore covers, for example, the following contents.

The embodiments described above have illustrated a color printer as an example of the image forming apparatus. In place of the color printer, the image forming apparatus may be a copy machine, a fax device, or a complex machine with the functions of these devices.

The embodiments described have also illustrated, as an example, a so-called tandem image forming apparatus in which image forming units of a plurality of colors are arranged, toner images formed on the image forming units are primarily transferred to an intermediate transfer belt, and the transferred toner images are secondarily transferred to a recording medium such as a sheet of paper. In place of the tandem image forming apparatus, the image forming apparatus may be the one that directly transfers the toner images on the image forming units to a recording medium such as a sheet of paper.

The embodiments described above have also illustrated an image forming apparatus in which the first developing device corresponds to the black photosensitive drum that forms a black-and-white image using the achromatic toner, and the second developing devices correspond to the color photosensitive drums that form a color image using the chromatic toners. In place of dividing the first and second developing devices into the black and colors, the first and second developing devices may be divided into one or a plurality of colors and other colors. For instance, a developing device corresponding to a yellow photosensitive drum may be treated as the first developing device, and developing devices corresponding to colors (including black) other than yellow may be treated as the second developing devices.

This application is based on Japanese Patent application Nos. 2010-129102 and 2010-290394 filed in the Japan Patent Office on Jun. 4, 2010 and Dec. 27, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

first and second image carriers that are configured by positively-charged single layer type electrophotographic photoreceptors;

first and second developing devices that supply toner of developers to circumferential surfaces of the first and second image carriers respectively;

first and second charging members that come into contact with the circumferential surfaces of the first and second image carriers, respectively, to charge the circumferential surfaces of the first and second image carriers;

a voltage application portion that applies a charging bias to each of the first and second charging members;

first and second destaticizing portions that destaticize the circumferential surfaces of the first and second image carriers respectively;

an image carrier driving portion that rotates the first and second image carriers; and a controller that controls an operation for charging or destaticizing the circumferential surfaces of the first and second image carriers, wherein the controller switches between a first mode for operating the first developing device and the second developing device while rotating the first image carrier and the second image carrier so as to form an image on both the first image carrier and the second image carrier, and a second mode for operating only the first developing device while rotating the first image carrier and the second image carrier so as to form an image only on the first image carrier; and in the second mode, applies the charging bias and operates the second destaticizing portion for the second image carrier without operating the second developing device, and applies the charging bias and operates the first developing device and the first destaticizing portion for the first image carrier.

2. The image forming apparatus according to claim 1, wherein the first developing device is a developing device for forming a black-and-white image using an achromatic toner, and the second developing device is a developing device for forming a color image using a chromatic toner.

3. The image forming apparatus according to claim 1, wherein, in the second mode, the controller sets the charging bias, which is applied to the second charging member, to be lower than the charging bias which is applied to the first charging member.

4. The image forming apparatus according to claim 1, wherein, when starting the first mode after the execution of the second mode, the controller controls the charging bias such that the charging bias that is applied to the second charging member by the voltage application portion becomes higher temporarily than a normal charging bias obtained during image formation, and thereafter gradually decreases the same to the normal charging bias.

* * * * *